US009972235B2

(12) United States Patent
Maruyama et al.

(10) Patent No.: US 9,972,235 B2
(45) Date of Patent: May 15, 2018

(54) LIQUID CRYSTAL DISPLAY DEVICE INCLUDING DISPLAY PANEL AND DISPLAY CONTROL CIRCUIT

(71) Applicant: Panasonic Liquid Crystal Display Co., Ltd., Hyogo (JP)

(72) Inventors: Junichi Maruyama, Hyogo (JP); Ryutaro Oke, Hyogo (JP)

(73) Assignee: PANASONIC LIQUID CRYSTAL DISPLAY CO., LTD., Hyogo (JP)

( * ) Notice: Subject to any disclaimer, the term of this patent is extended or adjusted under 35 U.S.C. 154(b) by 540 days.

(21) Appl. No.: 14/542,659

(22) Filed: Nov. 17, 2014

(65) Prior Publication Data

US 2016/0140927 A1 May 19, 2016

(51) Int. Cl.
*G09G 3/36* (2006.01)
*G09G 3/20* (2006.01)

(52) U.S. Cl.
CPC ..... *G09G 3/2007* (2013.01); *G09G 3/3688* (2013.01); *G09G 3/3607* (2013.01); *G09G 3/3677* (2013.01); *G09G 2310/0218* (2013.01); *G09G 2310/0251* (2013.01); *G09G 2320/0252* (2013.01)

(58) Field of Classification Search
CPC .. G09G 3/2007; G09G 3/3685; G09G 3/3688; G09G 2310/0251; G09G 2310/0252
USPC ..... 345/89
See application file for complete search history.

(56) References Cited

U.S. PATENT DOCUMENTS 6,750,840 B2 * 6/2004 Morita ..... G09G 3/3648 345/100
2004/0119705 A1 * 6/2004 Chen ..... G09G 3/3648 345/204
2011/0234644 A1 * 9/2011 Park ..... G09G 3/2003 345/690
2012/0229524 A1 * 9/2012 Toshima ..... G09G 3/3648 345/690
2015/0097871 A1 * 4/2015 Kumeta ..... G09G 3/2003 345/690
2015/0179131 A1 * 6/2015 Na ..... G09G 5/006 345/213
2015/0243212 A1 * 8/2015 Lee ..... G09G 3/3216 345/212
2016/0019824 A1 * 1/2016 Choi ..... G09G 3/3666 345/694

FOREIGN PATENT DOCUMENTS

JP 2008-292611 A 12/2008

* cited by examiner

*Primary Examiner* — Yuzhen Shen
(74) *Attorney, Agent, or Firm* — HEA Law PLLC

(57) ABSTRACT

In a liquid crystal display device, in a first half of one horizontal scanning period, a first data line driver circuit outputs a corrected grayscale voltage obtained by correcting an input grayscale voltage corresponding to input display data to a plurality of data lines, and a second data line driver circuit is electrically disconnected from the plurality of data lines, and in a second half of one horizontal scanning period, the second data line driver circuit outputs an input grayscale voltage corresponding to the input display data to the plurality of data lines, and the first data line driver circuit is electrically disconnected from the plurality of data lines.

12 Claims, 15 Drawing Sheets

FIG.3

| | | INPUT GRAYSCALE FOR CURRENT LINE (TARGET GRAYSCALE) | | | | | | |
|---|---|---|---|---|---|---|---|---|
| | | 0 | 32 | 64 | 128 | 192 | 224 | 255 |
| INPUT GRAYSCALE FOR PREVIOUS LINE | 0 | 0 | 50 | 50 | 48 | 29 | 21 | 0 |
| | 32 | 0 | 0 | 13 | 34 | 26 | 15 | 0 |
| | 64 | 0 | −15 | 0 | 26 | 23 | 14 | 0 |
| | 128 | 0 | −24 | −29 | 0 | 12 | 9 | 0 |
| | 192 | 0 | −26 | −45 | −18 | 0 | 4 | 0 |
| | 224 | 0 | −27 | −50 | −26 | −5 | 0 | 0 |
| | 255 | 0 | −28 | −53 | −35 | −12 | −2 | 0 |

| | | INPUT GRAYSCALE FOR CURRENT LINE (TARGET GRAYSCALE) | | | | | | |
|---|---|---|---|---|---|---|---|---|
| | | 0 | 32 | 64 | 128 | 192 | 224 | 255 |
| INPUT GRAYSCALE FOR PREVIOUS LINE | 0 | 0 | 82 | 114 | 176 | 221 | 245 | 255 |
| | 32 | 0 | 32 | 77 | 162 | 218 | 239 | 255 |
| | 64 | 0 | 17 | 64 | 154 | 215 | 238 | 255 |
| | 128 | 0 | 8 | 35 | 128 | 204 | 233 | 255 |
| | 192 | 0 | 6 | 19 | 110 | 192 | 228 | 255 |
| | 224 | 0 | 5 | 14 | 102 | 187 | 224 | 255 |
| | 255 | 0 | 4 | 11 | 93 | 180 | 222 | 255 |

LIQUID CRYSTAL DISPLAY DEVICE INCLUDING DISPLAY PANEL AND DISPLAY CONTROL CIRCUIT

BACKGROUND OF THE INVENTION

1. Field of the Invention

The present application relates to a liquid crystal display device and a driving method therefor.

2. Description of the Related Art

For liquid crystal display devices, there has hitherto been proposed a drive method for reliably charging a pixel with display data (grayscale voltage) by supplying the display data simultaneously from both sides of a data line (source line). In recent liquid crystal display devices, however, the resolution has become higher, resulting in a shorter pixel charge period. Thus, the related-art drive method has a problem in that a pixel is insufficiently charged with display data. A technology for solving this problem is disclosed in Japanese Patent Application Laid-open No. 2008-292611, for example.

In the display device disclosed in Japanese Patent Application Laid-open No. 2008-292611, a precharge selection circuit is provided on one end side of a source line, and a source selection circuit is provided on the other end side of the source line. The display device further includes a control circuit for precharging the source line. The control circuit is configured so that, when a pixel switch for a certain pixel among a plurality of pixels is turned on, precharge switches for source lines that are connected to the other pixels for which pixel switches are turned off are turned on.

SUMMARY OF THE INVENTION

In the technology disclosed in Japanese Patent Application Laid-open No. 2008-292611, however, a common voltage (Vcom) is supplied to the source line in a precharge period. Thus, a pixel cannot be precharged with a voltage corresponding to display data, with the result that some pixels may not reach a target voltage.

The present invention has been made in view of the above-mentioned problem, and it is an object thereof to provide a liquid crystal display device and a driving method therefor, which are capable of reliably charging a pixel with desired display data even in a high resolution display panel.

In order to solve the problem described above, according to one embodiment of the present application, there is provided a liquid crystal display device including: a display panel including a plurality of gate lines extending in a row direction and a plurality of data lines extending in a column direction; a first data line driver circuit electrically connected to one end of each of the plurality of data lines; a second data line driver circuit electrically connected to another end of the each of the plurality of data lines; and a display control circuit for inputting input display data from an outside. In a first half of one horizontal scanning period, the first data line driver circuit outputs a corrected grayscale voltage obtained by correcting an input grayscale voltage corresponding to the input display data to the plurality of data lines, and the second data line driver circuit is electrically disconnected from the plurality of data lines. In a second half of one horizontal scanning period, the second data line driver circuit outputs an input grayscale voltage corresponding to the input display data to the plurality of data lines, and the first data line driver circuit is electrically disconnected from the plurality of data lines.

In the liquid crystal display device according to one embodiment of the present application, the display control circuit may correct an input grayscale corresponding to the input display data to one of a grayscale higher than a target grayscale and a grayscale lower than the target grayscale.

In the liquid crystal display device according to one embodiment of the present application, the display control circuit may generate, based on a horizontal synchronization signal input from the outside, a first data latch signal to be output to the first data line driver circuit and a second data latch signal to be output to the second data line driver circuit, and the first data latch signal and the second data latch signal may be shifted from each other by a half period of one horizontal scanning period.

In the liquid crystal display device according to one embodiment of the present application, the first data line driver circuit may include a first switching section for switching the first data line driver circuit itself to a high impedance state, and the second data line driver circuit may include a second switching section for switching the second data line driver circuit itself to a high impedance state. The first switching section may set the first data line driver circuit to the high impedance state in a period during which the first data latch signal is at High level, and the second switching section may set the second data line driver circuit to the high impedance state in a period during which the second data latch signal is at High level.

The liquid crystal display device according to one embodiment of the present application may further include: a first switch section connected between the first data line driver circuit and the one end of the each of the plurality of data lines; and a second switch section connected between the second data line driver circuit and the another end of the each of the plurality of data lines. The first switch section may be switched on and off based on a first switching signal output from the display control circuit, and the second switch section may be switched on and off based on a second switching signal output from the display control circuit.

The liquid crystal display device according to one embodiment of the present application may further include: a first switch section connected between the first data line driver circuit and the one end of the each of the plurality of data lines; and a second switch section connected between the second data line driver circuit and the another end of the each of the plurality of data lines. The first switch section may be switched on and off based on the first data latch signal, and the second switch section may be switched on and off based on the second data latch signal.

In the liquid crystal display device according to one embodiment of the present application, when the first data latch signal is at Low level, the first switch section may become an ON state, and the first data line driver circuit may be electrically connected to the one end of the each of the plurality of data lines, and, when the first data latch signal is at High level, the first switch section may become an OFF state, and the first data line driver circuit may be electrically disconnected from the one end of the each of the plurality of data lines. When the second data latch signal is at Low level, the second switch section may become an ON state, and the second data line driver circuit may be electrically connected to the another end of the each of the plurality of data lines, and, when the second data latch signal is at High level, the second switch section may become an OFF state, and the second data line driver circuit may be electrically disconnected from the another end of the each of the plurality of data lines.

In the liquid crystal display device according to one embodiment of the present application, the first data line driver circuit may be arranged in a vicinity of a lower side of the display panel, and the second data line driver circuit may be arranged in a vicinity of an upper side of the display panel.

According to one embodiment of the present application, there is provided a liquid crystal display device, including: a display panel including a plurality of gate lines extending in a row direction and a plurality of data lines extending in a column direction; a first data line driver circuit electrically connected to one end of each of the plurality of data lines; a second data line driver circuit electrically connected to another end of the each of the plurality of data lines; and a display control circuit for inputting input display data from an outside. A display region of the display panel may be divided into an upper-half first region and a lower-half second region, and the first data line driver circuit may be arranged in a vicinity of an upper side of the display panel, and the second data line driver circuit may be arranged in a vicinity of a lower side of the display panel. In the upper-half first region, in a first half of one horizontal scanning period, the first data line driver circuit may output a corrected grayscale voltage obtained by correcting an input grayscale voltage corresponding to the input display data to the plurality of data lines, and the second data line driver circuit may be electrically disconnected from the plurality of data lines. In a second half of one horizontal scanning period, the second data line driver circuit may output an input grayscale voltage corresponding to the input display data to the plurality of data lines, and the first data line driver circuit may be electrically disconnected from the plurality of data lines. In the lower-half second region, in the first half of one horizontal scanning period, the second data line driver circuit may output a corrected grayscale voltage obtained by correcting the input grayscale voltage corresponding to the input display data to the plurality of data lines, and the first data line driver circuit may be electrically disconnected from the plurality of data lines. In the second half of one horizontal scanning period, the first data line driver circuit may output the input grayscale voltage corresponding to the input display data to the plurality of data lines, and the second data line driver circuit may be electrically disconnected from the plurality of data lines.

The liquid crystal display device according to one embodiment of the present application may further include: a first reference voltage generation circuit may generate a first reference voltage, and output the first reference voltage to the first data line driver circuit; and a second reference voltage generation circuit may generate a second reference voltage, and output the second reference voltage to the second data line driver circuit. The first reference voltage and the second reference voltage may be set to different voltages to each other.

According to one embodiment of the present application, there is provided a driving method for a liquid crystal display device including: a display panel including a plurality of gate lines extending in a row direction and a plurality of data lines extending in a column direction; a first data line driver circuit electrically connected to one end of each of the plurality of data lines; a second data line driver circuit electrically connected to another end of the each of the plurality of data lines; and a display control circuit for inputting input display data from an outside. The method includes: outputting, in a first half of one horizontal scanning period, by the first data line driver circuit, a corrected grayscale voltage obtained by correcting an input grayscale voltage corresponding to the input display data to the plurality of data lines, and electrically disconnecting the second data line driver circuit from the plurality of data lines; and outputting, in a second half of one horizontal scanning period, by the second data line driver circuit, an input grayscale voltage corresponding to the input display data to the plurality of data lines, and electrically disconnecting the first data line driver circuit from the plurality of data lines.

BRIEF DESCRIPTION OF THE DRAWINGS

FIG. 3 is a diagram showing an exemplary lookup table.

DETAILED DESCRIPTION OF THE INVENTION

Figure 1:
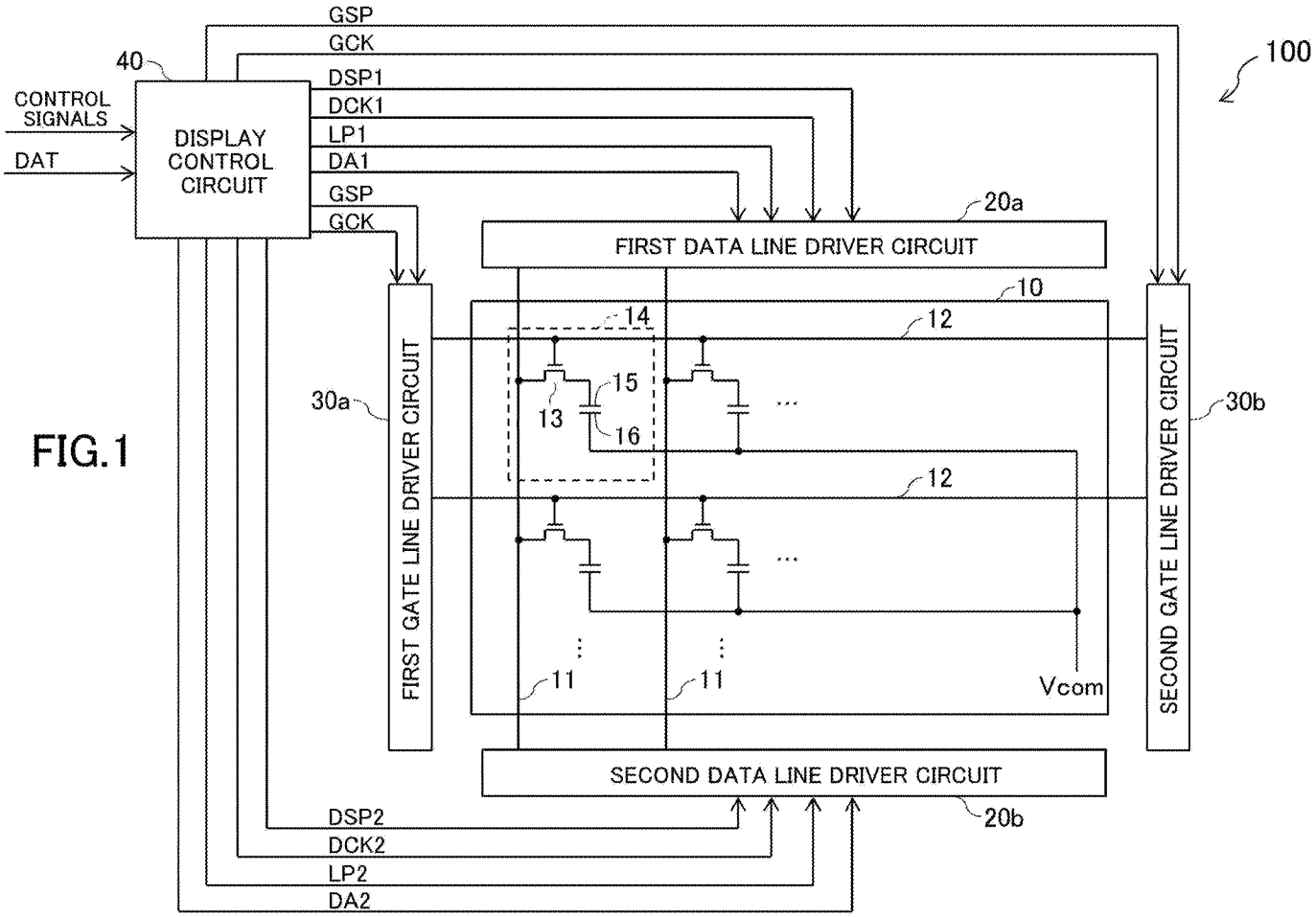
FIG. 1 is a plan view illustrating a schematic configuration of a liquid crystal display device according to one embodiment of the present application.

One embodiment of the present application is described below with reference to the attached drawings. FIG. 1 is a plan view illustrating a schematic configuration of a liquid crystal display device according to this embodiment. A liquid crystal display device 100 includes a display panel 10, a first data line driver circuit 20*a*, a second data line driver circuit 20*b*, a first gate line driver circuit 30*a*, a second gate line driver circuit 30*b*, a display control circuit 40, and a backlight unit (not shown).

In the display panel 10, a plurality of data lines 11 extending in a column direction and a plurality of gate lines 12 extending in a row direction are arranged. A thin film transistor 13 (TFT) is arranged at each intersection of each data line 11 and each gate line 12. One end of each data line 11 is connected to the first data line driver circuit 20*a*, and the other end of each data line 11 is connected to the second data line driver circuit 20*b*. One end of each gate line 12 is connected to the first gate line driver circuit 30*a*, and the other end of each gate line 12 is connected to the second gate line driver circuit 30*b*.

Further, in the display panel 10, a plurality of pixels 14 are arranged in matrix (in row direction and column direction) to correspond to each intersection of each data line 11 and each gate line 12. Note that, although not illustrated, the display panel 10 includes a thin film transistor substrate (TFT substrate), a color filter substrate (CF substrate), and a liquid crystal layer sandwiched between both the substrates. In the TFT substrate, a plurality of pixel electrodes 15 are arranged to correspond to respective pixels 14. In the CF substrate, a common electrode 16 in common among the pixels 14 is arranged. Note that, the common electrode 16 may be arranged in the TFT substrate.

Each data line 11 is supplied with a first data voltage Dout1 from the first data line driver circuit 20*a* and with a second data voltage Dout2 from the second data line driver circuit 20*b*. The first data voltage Dout1 and the second data voltage Dout2 are supplied to the same data line 11 at different timings. Each gate line 12 is supplied with a gate signal Gout from the first gate line driver circuit 30*a* and the second gate line driver circuit 30*b*. The common electrode 16 is supplied with a common voltage Vcom from a common electrode driver circuit (not shown). When an ON voltage of the gate signal Gout is supplied to the gate line 12, the thin film transistors 13 connected to the gate line 12 are turned on, and the data voltage (first data voltage Dout1, second data voltage Dout2) is supplied to the pixel electrode 15 via the data line 11 connected to the thin film transistor 13. An electric field is generated based on a difference between the data voltage supplied to the pixel electrode 15 and the common voltage Vcom supplied to the common electrode 16. This electric field is used to drive liquid crystal to control the transmissivity of light from the backlight unit, to thereby display an image. Note that, color display is realized in a manner that a desired data voltage is supplied to each of the data lines 11 connected to the pixel electrodes 15 of the pixels 14 corresponding to red, green, and blue that are formed by a vertical striped color filter.

In the liquid crystal display device 100, each data line 11 is supplied with the first data voltage Dout1 from the first data line driver circuit 20*a* in the first half of one horizontal scanning period and with the second data voltage Dout2 from the second data line driver circuit 20*b* in the second half of one horizontal scanning period. Further, in the liquid crystal display device 100, the second data line driver circuit 20*b* is electrically disconnected from the data line 11 in the period during which the first data line driver circuit 20*a* supplies the first data voltage Dout1 to the data line 11, and the first data line driver circuit 20*a* is electrically disconnected from the data line 11 in the period during which the second data line driver circuit 20*b* supplies the second data voltage Dout2 to the data line 11. The data line 11 can be electrically disconnected from the data line driver circuit by, for example, a method involving setting the data line driver circuit to a high impedance (Hi-Z) state (first method) and a method involving connecting a switch between the data line driver circuit and the data line 11 and switching ON/OFF of the switch (second method). The configurations for realizing the first method and the second method are described later.

Further, in the liquid crystal display device 100, the first data voltage Dout1 is a grayscale voltage that is corrected to be higher or lower than a target grayscale voltage, and the second data voltage Dout2 is the target grayscale voltage. The gate line 12 is supplied with the same gate signal Gout at the same timing from the first gate line driver circuit 30*a* and the second gate line driver circuit 30*b*. Note that, the second gate line driver circuit 30*b* may be omitted from the liquid crystal display device 100.

The display control circuit 40 controls driving of the first data line driver circuit 20*a*, the second data line driver circuit 20*b*, the first gate line driver circuit 30*a*, and the second gate line driver circuit 30*b*. Specifically, the display control circuit 40 generates first display data DA1 and second display data DA2 for image display and various timing signals for controlling the respective driver circuits based on input display data DAT (video signal) and control signals (such as clock signal, vertical synchronization signal, and horizontal synchronization signal), which are input from an external display system (signal source). The display control circuit 40 outputs the first display data DA1, a data start pulse DSP1, a data clock DCK1, and a data latch pulse LP1 to the first data line driver circuit 20*a*. The display control circuit 40 outputs the second display data DA2, a data start pulse DSP2, a data clock DCK2, and a data latch pulse LP2 to the second data line driver circuit 20*b*. The display control circuit 40 outputs a gate clock GCK and a gate start pulse GSP to the first gate line driver circuit 30*a* and the second gate line driver circuit 30*b*.

Figure 2:
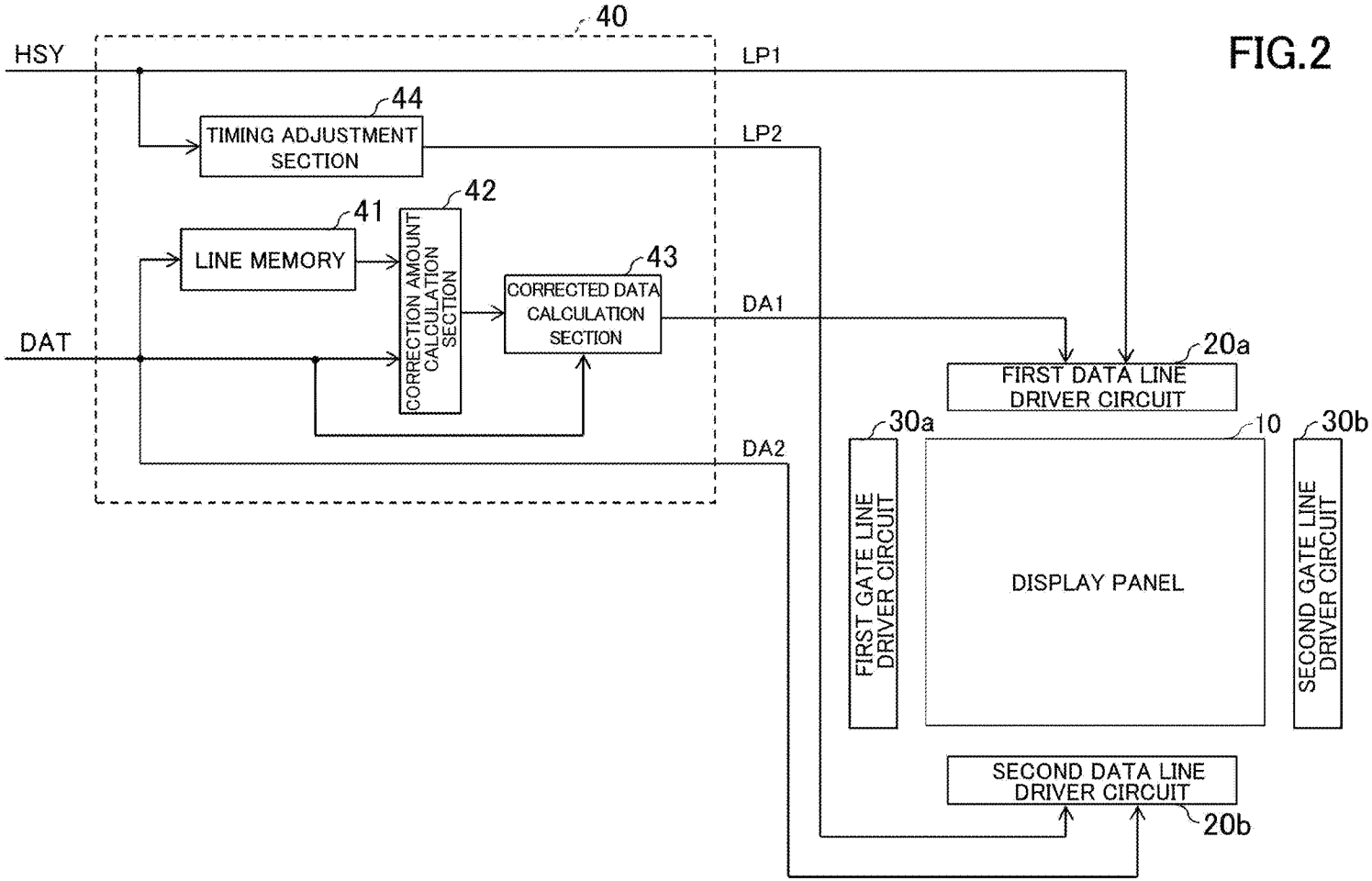
FIG. 2 is a functional block diagram illustrating a configuration of a display control circuit.

FIG. 2 is a functional block diagram illustrating a configuration of the display control circuit 40. The display control circuit 40 includes a line memory 41, a correction amount calculation section 42, a corrected data calculation section 43, and a timing adjustment section 44.

The line memory 41 stores the input display data DAT corresponding to pixels for one line. The line memory 41 can be constructed by a first-in first-out (FIFO) memory, a random access memory (RAM), or other such memories. The line memory 41 may store the input display data DAT corresponding to pixels for a plurality of lines, or may store the input display data DAT corresponding to pixels for one or a plurality of frames. When input display data DAT(n) for the n-th line (current line) is input to the display control circuit 40, input display data DAT(n−1) for the line one line before the n-th line (previous line, (n−1)th line) stored in the line memory 41 is read from the line memory 41, and the input display data DAT(n) for the current line is stored in the line memory 41. The above-mentioned "n" represents the number of a line to be scanned (see FIG. 6).

The correction amount calculation section 42 calculates a correction amount for correcting the grayscale (input grayscale) corresponding to the input display data DAT(n) for the current line based on the input display data DAT(n) for the current line, which is input to the display control circuit 40, and on the input display data DAT(n−1) for the previous line, which is read from the line memory 41. For example, the correction amount calculation section 42 calculates the correction amount by referring to a lookup table. FIG. 3 shows an example of the lookup table. The lookup table shown in FIG. 3 stores the correction amounts set in advance in association with combinations of the input grayscales of the input display data DAT(n) for the current line and the input grayscales of the input display data DAT(n−1) for the previous line. The correction amounts are set so that the amount of a change from the input grayscale for the previous line to the input grayscale for the current line may be increased. The correction amount calculation section 42 may calculate the correction amount by calculation. Note that, the input grayscale of the input display data DAT(n) is a target grayscale to be intended to be displayed (target grayscale).

The corrected data calculation section 43 corrects the input grayscale of the input display data DAT(n) for the current line, which is input to the display control circuit 40, based on the correction amount calculated by the correction amount calculation section 42. The input display data DAT (n) having the corrected input grayscale is output to the first data line driver circuit 20*a* as first display data DA1(*n*). For example, the corrected data calculation section 43 adds the correction amount (see FIG. 3) to the input grayscale corresponding to the input display data DAT(n). The grayscale obtained by the addition is referred to as "corrected grayscale". The first display data DA1(*n*) corresponding to the corrected grayscale is output to the first data line driver circuit 20*a*. The corrected data calculation section 43 can be constructed by an adder.

Figures 4, 5:
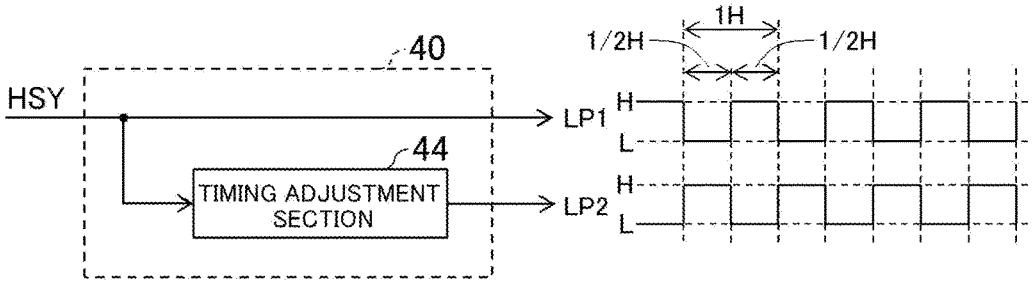
FIG. 4 is a diagram showing another exemplary lookup table.
FIG. 5 is a waveform diagram of data latch pulses.

The corrected data calculation section 43 may calculate the corrected grayscale by referring to a lookup table shown in FIG. 4. The lookup table shown in FIG. 4 stores the corrected grayscales set in advance in association with combinations of the input grayscales of the input display data DAT(n) for the current line and the input grayscales of the input display data DAT(n−1) for the previous line. In this case, the correction amount calculation section 42 can be omitted from the display control circuit 40.

According to the above-mentioned configuration, the input display data DAT(n) input to the display control circuit 40 is output to the first data line driver circuit 20*a* as the first display data DA1(*n*) after the input grayscale thereof is corrected to a grayscale higher or lower than the target grayscale.

Further, as illustrated in FIG. 2, the input display data DAT(n) input to the display control circuit 40 is output to the second data line driver circuit 20*b* as second display data DA2(*n*) without the input grayscale thereof corrected.

The timing adjustment section 44 adjusts the rise and fall timings of a horizontal synchronization signal HSY input to the display control circuit 40. Specifically, the timing adjustment section 44 delays the rise and fall timings of the horizontal synchronization signal HSY by a half (½H) of one horizontal scanning period (1H). The timing adjustment section 44 can be constructed by a delay circuit. The display control circuit 40 outputs a signal having the adjusted timings to the second data line driver circuit 20*b* as the data latch pulse LP2. Further, the display control circuit 40 outputs the input horizontal synchronization signal HSY to the first data line driver circuit 20*a* as the data latch pulse LP1 without adjusting the timings thereof. FIG. 5 shows the waveforms of the data latch pulse LP1 and the data latch pulse LP2. The data latch pulse LP1 and the data latch pulse LP2 have the relationship in which the period of High level and the period of Low level are opposite to each other.

Note that, FIG. 2 omits the data start pulses DSP1 and DSP2, the data clocks DCK1 and DCK2, the gate clock GCK, and the gate start pulse GSP, which are output from the display control circuit 40. Those timing signals are generated by well-known configurations.

Figure 6:
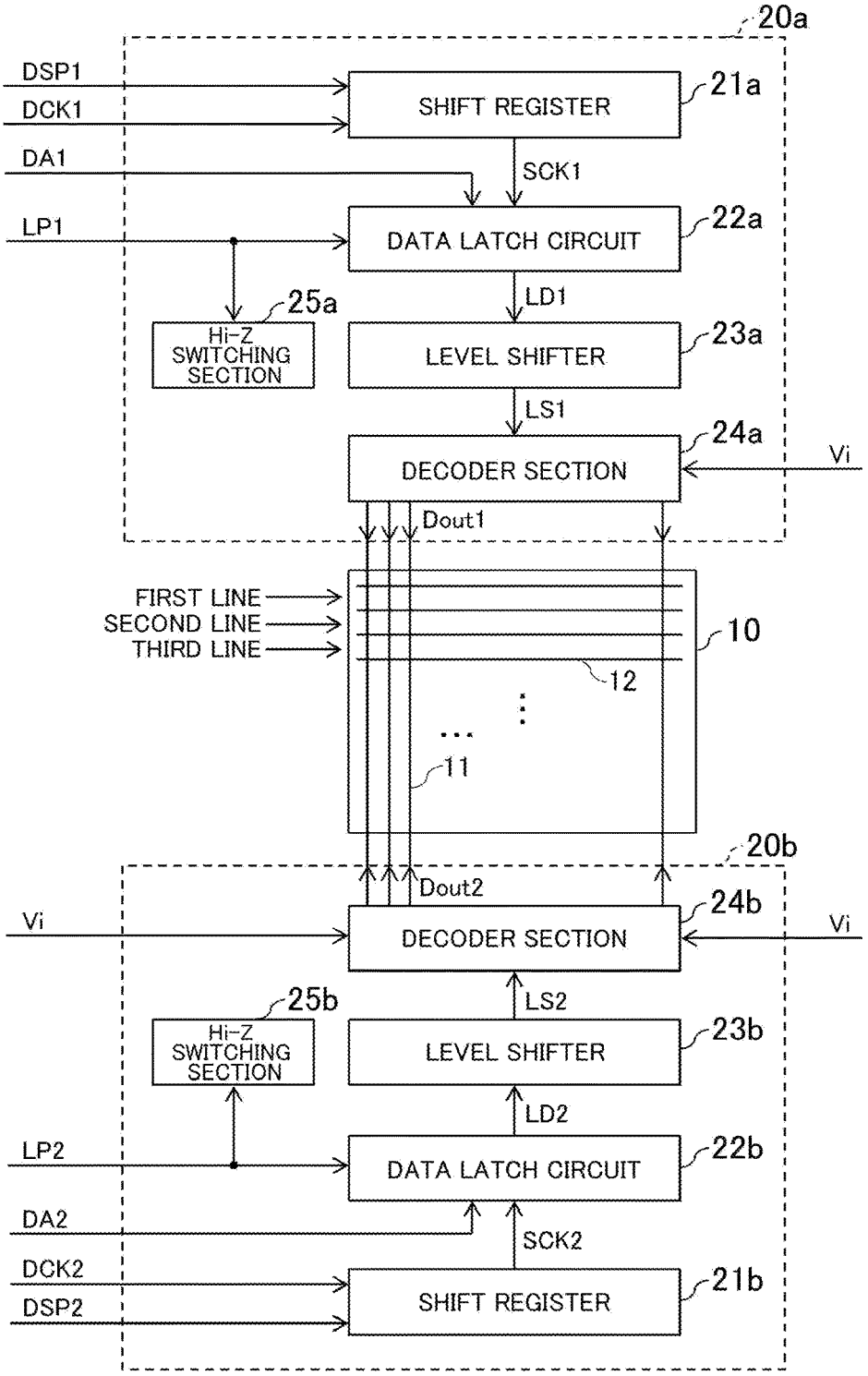
FIG. 6 is a block diagram illustrating a configuration of a liquid crystal display device according to Configuration Example 1.

FIG. 6 is a block diagram illustrating configurations of the first data line driver circuit 20*a* and the second data line driver circuit 20*b* (Configuration Example 1).

The first data line driver circuit 20*a* inputs the first display data DA1, the data start pulse DSP1, the data clock DCK1, and the data latch pulse LP1, which are output from the display control circuit 40 (see FIG. 2).

The first data line driver circuit 20*a* includes a shift register 21*a* for inputting the data start pulse DSP1 and the data clock DCK1, a data latch circuit 22*a* for fetching the first display data DA1 in response to the data latch pulse LP1 and a shift clock SCK1 output from the shift register 21*a*, a level shifter 23*a* for converting latch data LD1 output from the data latch circuit 22*a* into a desired voltage level, a decoder section 24*a* for selecting a display grayscale voltage based on a reference voltage Vi input from the outside and level shift data LS1 output from the level shifter 23*a*, and a high impedance switching section 25*a* (first switching section) for switching the first data line driver circuit 20*a* to a high impedance (Hi-Z) state based on the data latch pulse LP1. The first data line driver circuit 20*a* outputs the display grayscale voltage selected by the decoder section 24*a* to one end of the data line 11 as the first data voltage Dout1. A well-known configuration can be applied to each of the shift register 21*a*, the data latch circuit 22*a*, the level shifter 23*a*, and the decoder section 24*a*.

The first data line driver circuit 20*a* fetches the first display data DA1 from the display control circuit 40 at a timing at which the data latch pulse LP1 input from the display control circuit 40 rises from Low level to High level, and outputs a display grayscale voltage corresponding to the fetched first display data DA1 to the data line 11 as the first data voltage Dout1 at a timing at which the data latch pulse LP1 falls from High level to Low level. Further, the first data line driver circuit 20*a* sets the first data line driver circuit 20*a* to the high impedance (Hi-Z) state at the timing at which the data latch pulse LP1 rises from Low level to High level, and maintains the high impedance (Hi-Z) state during the period of High level.

The second data line driver circuit 20*b* inputs the second display data DA2, the data start pulse DSP2, the data clock DCK2, and the data latch pulse LP2, which are output from the display control circuit 40 (see FIG. 2).

The second data line driver circuit 20*b* includes a shift register 21*b* for inputting the data start pulse DSP2 and the data clock DCK2, a data latch circuit 22*b* for fetching the second display data DA2 in response to the data latch pulse LP2 and a shift clock SCK2 output from the shift register 21*b*, a level shifter 23*b* for converting latch data LD2 output from the data latch circuit 22*b* into a desired voltage level, a decoder section 24*b* for selecting a display grayscale voltage based on the reference voltage Vi input from the outside and level shift data LS2 output from the level shifter 23*b*, and a high impedance switching section 25*b* (second switching section) for switching the second data line driver circuit 20*b* to the high impedance (Hi-Z) state based on the data latch pulse LP2. The second data line driver circuit 20*b* outputs the display grayscale voltage selected by the voltage decoder 24*b* to the other end of the data line 11 as the second data voltage Dout2. A well-known configuration can be applied to each of the shift register 21*b*, the data latch circuit 22*b*, the level shifter 23*b*, and the decoder section 24*b*.

The second data line driver circuit 20*b* fetches the second display data DA2 from the display control circuit 40 at a timing at which the data latch pulse LP2 input from the display control circuit 40 rises from Low level to High level, and outputs a display grayscale voltage corresponding to the fetched second display data DA2 to the data line 11 as the second data voltage Dout2 at a timing at which the data latch pulse LP2 falls from High level to Low level. Further, the second data line driver circuit 20*b* sets the second data line driver circuit 20*b* to the high impedance (Hi-Z) state at a timing at which the data latch pulse LP2 rises from Low level to High level, and maintains the high impedance (Hi-Z) state during the period of High level.

Figure 7:
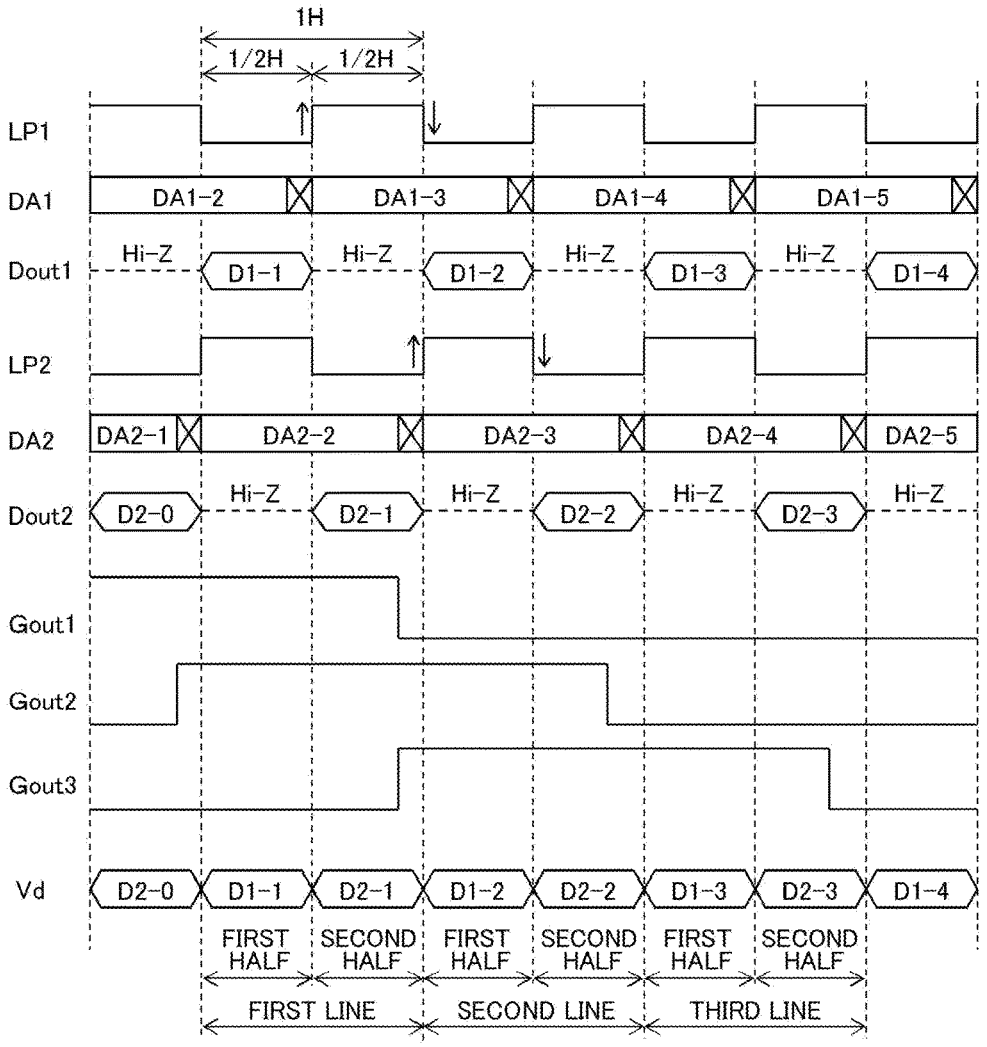
FIG. 7 is a timing chart showing operation timings of the liquid crystal display device according to Configuration Example 1.

FIG. 7 is a timing chart showing operation timings of the liquid crystal display device 100. Symbol LP1 represents the data latch pulse to be input to the first data line driver circuit 20*a*, and symbol LP2 represents the data latch pulse to be input to the second data line driver circuit 20*b*. Symbol DA1 represents the first display data to be input to the first data line driver circuit 20*a*, and symbol DA2 represents the second display data to be input to the second data line driver circuit 20*b*. Symbol DA1-2 represents first display data corresponding to the second line, and symbol DA2-2 represents second display data corresponding to the second line. Symbol Dout1 represents the first data voltage to be output from the first data line driver circuit 20*a*, and symbol Dout2 represents the second data voltage to be output from the second data line driver circuit 20*b*. Symbol D1-2 represents a first data voltage corresponding to the second line, and symbol D2-2 represents a second data voltage corresponding to the second line. Symbols Gout1, Gout2, and Gout3 represent gate voltages to be supplied to the gate lines 12 corresponding to the first line, the second line, and the third line, respectively. Symbol Vd represents the first data voltage Dout1 and the second data voltage Dout2 to be supplied to the data line 11. Now, an example of the operation of the liquid crystal display device 100 is described.

In FIG. 7, when the data latch pulse LP1 rises from Low level to High level (up arrow in FIG. 7), the first data line driver circuit 20*a* fetches the first display data DA1-2 corresponding to the second line. In the period during which the data latch pulse LP1 is at High level, the first data line driver circuit 20*a* becomes the high impedance (Hi-Z) state to perform processing of transferring the first display data DA1-2. When the data latch pulse LP1 falls from High level to Low level (down arrow in FIG. 7), the first data line driver circuit 20*a* outputs the first data voltage D1-2 corresponding to the first display data DA1-2 to the data line 11. In the period during which the data latch pulse LP1 is at Low level, the first data voltage D1-2 is output to the data line 11. After that, the above-mentioned processing is repeated.

When the gate voltage Gout2 of ON level is supplied to the gate line 12 for the second line, the thin film transistor 13 connected to the gate line 12 is turned ON. When the thin film transistor 13 is turned ON, the first data voltage D1-2 output to the data line 11 is supplied to the pixel electrode 15 connected to the thin film transistor 13.

In FIG. 7, when the data latch pulse LP2 rises from Low level to High level (up arrow in FIG. 7), the second data line driver circuit 20*b* fetches the second display data DA2-2 corresponding to the second line. In the period during which the data latch pulse LP2 is at High level, the second data line driver circuit 20*b* becomes the high impedance (Hi-Z) state to perform processing of transferring the second display data DA2-2. When the data latch pulse LP2 falls from High level to Low level (down arrow in FIG. 7), the second data line driver circuit 20*b* outputs the second data voltage D2-2 corresponding to the second display data DA2-2 to the data line 11. In the period during which the data latch pulse LP2 is at Low level, the second data voltage D2-2 is output to the data line 11. After that, the above-mentioned processing is repeated.

When the gate voltage Gout2 of ON level is supplied to the gate line 12 for the second line, the thin film transistors 13 connected to the gate line 12 are turned on. When the thin film transistor 13 is turned on, the second data voltage D2-2 output to the data line 11 is supplied to the pixel electrode 15 connected to the thin film transistor 13. The second data voltage D2-2 is maintained at a timing at which the gate voltage Gout2 becomes OFF level. Note that, the pulse width of the gate signal is set to two horizontal scanning periods (2H) in order that the pixel can be reliably charged with the data voltage.

As shown in FIG. 5, the data latch pulse LP1 and the data latch pulse LP2 have the relationship in which the period of High level and the period of Low level are opposite to each other. Specifically, the data latch pulse LP2 becomes Low level in the period during which the data latch pulse LP1 is at High level, and the data latch pulse LP2 becomes High level in the period during which the data latch pulse LP1 is at Low level. Thus, in the period during which the first data line driver circuit 20*a* outputs the first data voltage Dout1 to the data line 11 (first half of one horizontal scanning period (1H)), the second data line driver circuit 20*b* becomes the high impedance (Hi-Z) state and is electrically disconnected from the data line 11. Similarly, in the period during which the second data line driver circuit 20*b* outputs the second data voltage Dout2 to the data line 11 (second half of one horizontal scanning period (1H)), the first data line driver circuit 20*a* becomes the high impedance (Hi-Z) state and is electrically disconnected from the data line 11. In the period during which the first data line driver circuit 20*a* and the second data line driver circuit 20*b* are electrically disconnected from the data line 11, the processing of data transfer is performed inside the first data line driver circuit 20*a* and the second data line driver circuit 20*b*.

Figure 8:
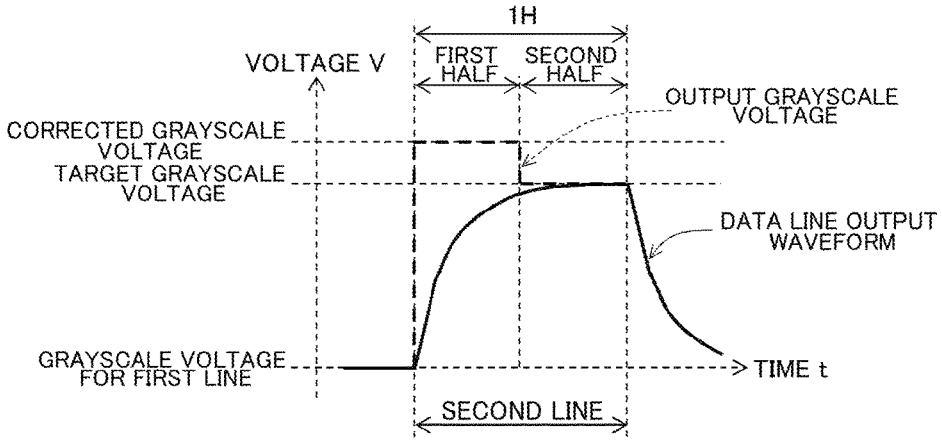
FIG. 8 is a graph showing a waveform of an output grayscale voltage and an output waveform of a data line.

Further, the first display data DA1 is obtained by correcting the input grayscale thereof to be higher or lower than a target grayscale. Thus, the first data voltage Dout1 in the first half of one horizontal scanning period (1H) is higher or lower than a target grayscale voltage. In contrast, the second display data DA2 has an input grayscale corresponding to the target grayscale. Thus, the second data voltage Dout2 in the second half of one horizontal scanning period (1H) is the target grayscale voltage. FIG. 8 is a graph showing the waveform of an output grayscale voltage and the output waveform in the data line 11 in the second line. In the example of FIG. 8, a grayscale voltage higher than a target grayscale voltage is supplied to the data line 11 in the first half of one horizontal scanning period (1H), and the target grayscale voltage is supplied to the data line 11 in the second half of one horizontal scanning period (1H).

According to the configuration of the liquid crystal display device 100 of this embodiment, a corrected grayscale is written into a pixel in the first half of one horizontal scanning period (1H), and a target grayscale is written in the pixel in the second half thereof, and hence the time period necessary for the pixel to reach the target grayscale can be shortened. Consequently, response performance of the display panel 10 can be improved to realize a higher resolution of the display panel 10. Besides, the first data line driver circuit 20*a* and the second data line driver circuit 20*b* can secure the same data transfer period (transfer rate) as that of the related-art data line driver circuit. Consequently, the related-art data line driver circuit can be used to provide a high resolution panel with low cost.

As described above, the method involving setting the data line driver circuit to the high impedance (Hi-Z) state (first method) and the method involving connecting a switch between the data line driver circuit and the data line 11 and switching ON/OFF of the switch (second method) are available. The configuration illustrated in FIG. 6 is the configuration for realizing the first method (Configuration Example 1). Now, the configuration for realizing the second method (Configuration Example 2) is described.

Figure 9:
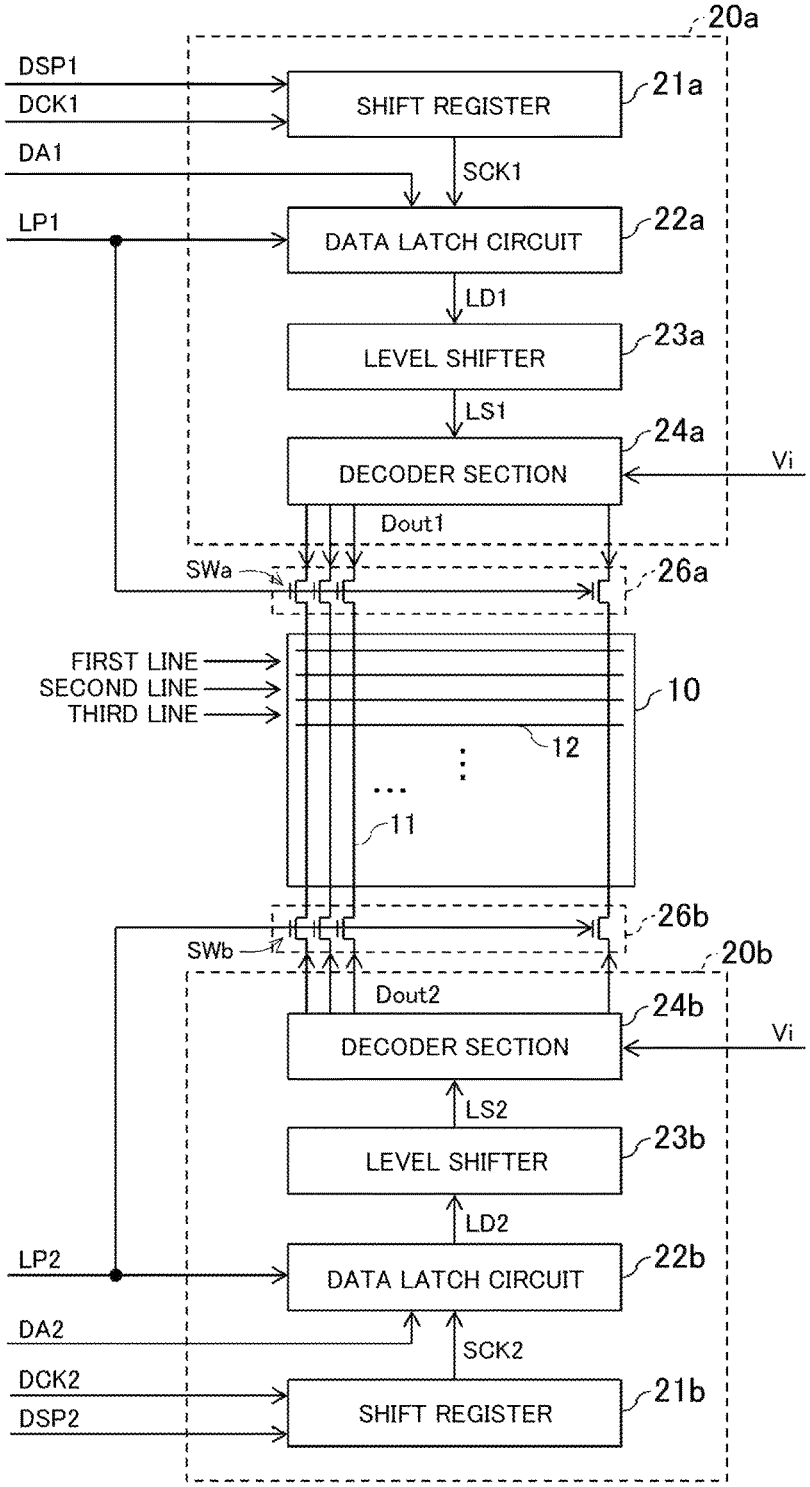
FIG. 9 is a block diagram illustrating a configuration of a liquid crystal display device according to Configuration Example 2.

FIG. 9 is a block diagram illustrating a configuration of a liquid crystal display device 100 according to Configuration Example 2. As compared to the liquid crystal display device 100 according to Configuration Example 1 (see FIG. 6), the liquid crystal display device 100 according to Configuration Example 2 is different in that a first switch section 26*a* and a second switch section 26*b* are added and the high impedance switching sections 25*a* and 25*b* are omitted. Other configurations are the same as those of the liquid crystal display device 100 according to Configuration Example 1.

The first switch section 26*a* includes a plurality of switches SWa corresponding to the plurality of data lines 11. The switch SWa is formed of a transistor, for example. One end (source electrode) of the switch SWa is connected to the decoder section 24*a*, and the other end (drain electrode) thereof is connected to the data line 11. A control electrode (gate electrode) of the switch SWa inputs the data latch pulse LP1 from the display control circuit 40. The data latch pulse LP1 functions as a switching signal for switching ON/OFF of each switch SWa. When the data latch pulse LP1 of Low level is supplied to the control electrode, the switch SWa is turned on so that the first data voltage Dout1 is output from the first data line driver circuit 20*a* to the data line 11. When the data latch pulse LP1 of High level is supplied to the control electrode, the switch SWa is turned off so that the first data line driver circuit 20*a* and the data line 11 are electrically disconnected from each other.

The second switch section 26*b* includes a plurality of switches SWb corresponding to the plurality of data lines 11. The switch SWb is formed of a transistor, for example. One end (source electrode) of the switch SWb is connected to the decoder section 24*b*, and the other end (drain electrode) thereof is connected to the data line 11. A control electrode (gate electrode) of the switch SWb inputs the data latch pulse LP2 from the display control circuit 40. The data latch pulse LP2 functions as a switching signal for switching ON/OFF of each switch SWb. When the data latch pulse LP2 of Low level is supplied to the control electrode, the switch SWb is turned on so that the second data voltage Dout2 is output from the second data line driver circuit 20*b* to the data line 11. When the data latch pulse LP2 of High level is supplied to the control electrode, the switch SWb is turned off so that the second data line driver circuit 20*b* and the data line 11 are electrically disconnected from each other.

Figure 10:
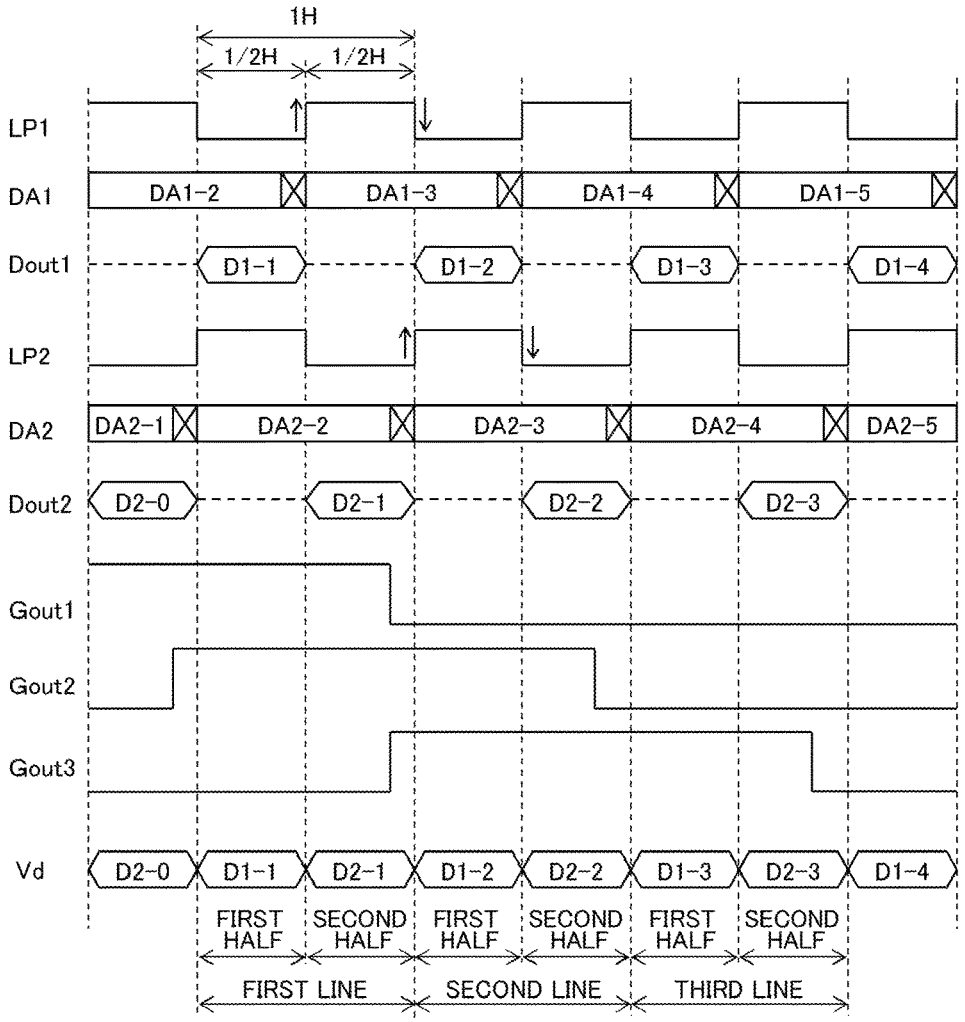
FIG. 10 is a timing chart showing operation timings of the liquid crystal display device according to Configuration Example 2.

FIG. 10 is a timing chart showing operation timings of the liquid crystal display device 100 according to Configuration Example 2. As compared to the timing chart of FIG. 7, the timing chart of FIG. 10 is different in that the indication of high impedance (Hi-Z) is omitted, but the rest is the same. In the liquid crystal display device 100 according to Configuration Example 2, the first data voltage Dout1 is not output from the first data line driver circuit 20*a* to the data line 11 in the period during which the data latch pulse LP1 is at High level, and the second data voltage Dout2 is not output from the second data line driver circuit 20*b* to the data line 11 in the period during which the data latch pulse LP2 is at High level.

Figure 11:
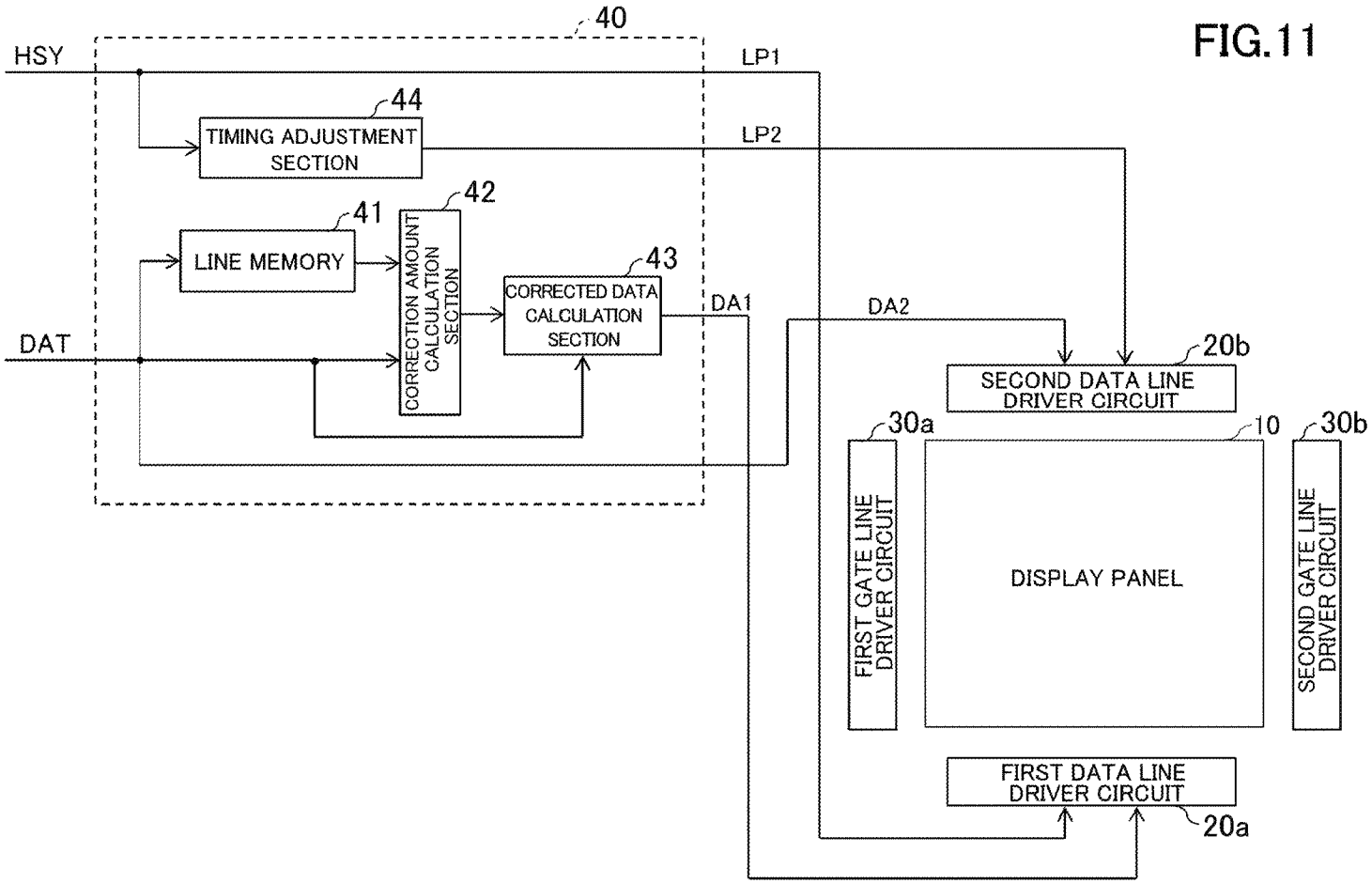
FIG. 11 is a plan view illustrating a configuration of a liquid crystal display device according to Modified Example 1.

The liquid crystal display device 100 according to this embodiment is not limited to the above-mentioned configuration. FIG. 11 is a plan view illustrating the configuration of a liquid crystal display device 100 according to Modified Example 1.

In the configuration of the liquid crystal display device 100 illustrated in FIG. 2, the first data line driver circuit 20*a* is arranged in the vicinity of the upper side of the display panel 10, and the second data line driver circuit 20*b* is arranged in the vicinity of the lower side of the display panel 10. In this case, the first data line driver circuit 20*a* outputs a corrected grayscale voltage having a larger amplitude than that of the input grayscale voltage, and hence consumption power of the first data line driver circuit 20*a* is larger than that of the second data line driver circuit 20*b*. Further, in general, the display panel 10 has a higher temperature on the upper side in the use state. In view of this, in the liquid crystal display device 100 according to Modified Example 1, as illustrated in FIG. 11, the first data line driver circuit 20*a* is arranged in the vicinity of the lower side of the display panel 10, and the second data line driver circuit 20*b* is arranged in the vicinity of the upper side of the display panel 10. In this manner, the heat distribution in the display panel 10 can be dispersed to suppress the occurrence of a malfunction caused by heat. Note that, the operation timings of the liquid crystal display device 100 according to Modified Example 1 are the same as those of the timing chart shown in FIG. 7.

Figure 12:
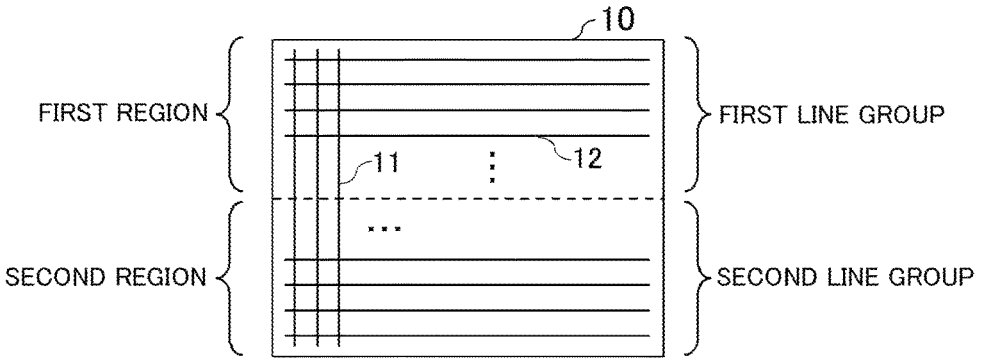
FIG. 12 is a plan view illustrating a display region of a display panel.

A liquid crystal display device 100 according to Modified Example 2 is now described. In general, in pixel arrangement, a pixel closer to the data line driver circuit is more easily charged. Specifically, a pixel closer to the first data line driver circuit 20*a* and a pixel closer to the second data line driver circuit 20*b* are more easily charged as compared to pixels in the vicinity of the center of the display panel 10. In view of this, in the liquid crystal display device 100 according to Modified Example 2, the display region is divided into an upper-half first region and a lower-half second region (see FIG. 12). In the liquid crystal display device 100, the first data line driver circuit 20*a* outputs a corrected grayscale voltage to a first line group corresponding to the first region in the first half of one horizontal scanning period (1H), and the second data line driver circuit 20*b* outputs a target grayscale voltage thereto in the second half of one horizontal scanning period (1H). Further, in the liquid crystal display device 100, the second data line driver circuit 20*b* outputs a corrected grayscale voltage to a second line group corresponding to the second region in the first half of one horizontal scanning period (1H), and the first data line driver circuit 20*a* outputs a target grayscale voltage thereto in the second half of one horizontal scanning period (1H).

Figure 13:
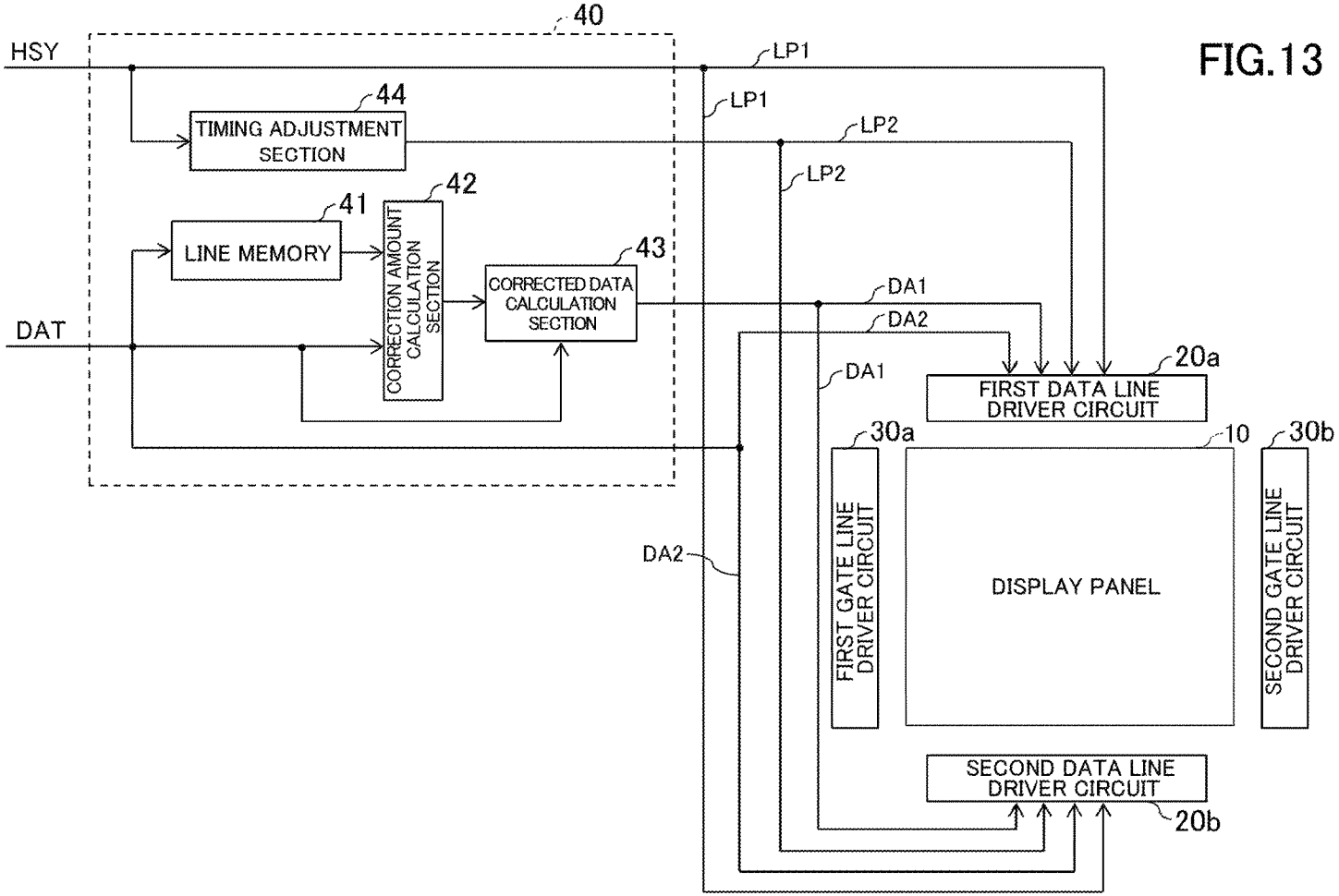
FIG. 13 is a plan view illustrating a configuration of a liquid crystal display device according to Modified Example 2.

FIG. 13 is a plan view illustrating a configuration of the liquid crystal display device 100 according to Modified Example 2. The data latch pulse LP1 and the first display data DA1 are input to the first data line driver circuit 20*a* for the first line group (corresponding to the first half of one frame) and to the second data line driver circuit 20*b* for the second line group (corresponding to the second half of one frame). Further, the data latch pulse LP2 and the second display data DA2 are input to the second data line driver circuit 20*b* for the first line group (corresponding to the first half of one frame) and to the first data line driver circuit 20*a* for the second line group (corresponding to the second half of one frame). The input of each of the above-mentioned signals is switched through the adjustment of the output timing of the display control circuit 40, for example.

Figure 14:
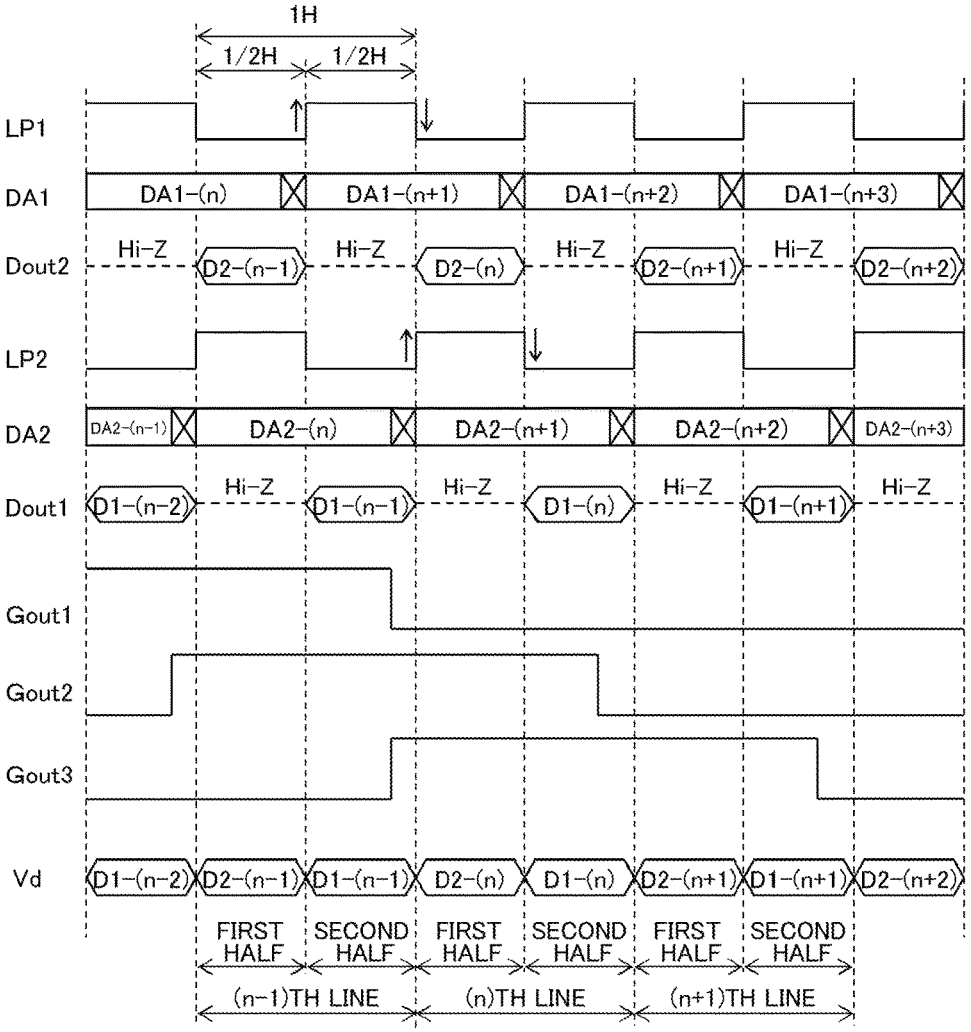
FIG. 14 is a timing chart showing operation timings of the liquid crystal display device according to Modified Example 2.

Operation timings for the first line group corresponding to the first region are the same as those shown in FIG. 7. FIG. 14 is a timing chart showing operation timings for the second line group corresponding to the second region. FIG. 14 shows the operation timings for a plurality of lines including the n-th line arranged in the vicinity of the second data line driver circuit 20*b*. In the second line group, the second data line driver circuit 20*b* fetches first display data DA1-(*n*) at a timing at which the data latch pulse LP1 rises from Low level to High level, and outputs a display grayscale voltage corresponding to the fetched first display data DA1-(*n*) to the data line 11 as a second data voltage D2-(*n*) at a timing at which the data latch pulse LP1 falls from High level to Low level. Further, the first data line driver circuit 20*a* fetches second display data DA2-(*n*) at a timing at which the data latch pulse LP2 rises from Low level to High level, and outputs a display grayscale voltage corresponding to the fetched second display data DA2-(*n*) to the data line 11 as a first data voltage D1-(*n*) at a timing at which the data latch pulse LP2 falls from High level to Low level.

According to the configuration of the liquid crystal display device 100 of Modified Example 2, one of the data line driver circuits closer to a pixel is configured to output a corrected grayscale voltage to a line corresponding to the pixel. Consequently, the efficiency of charging the pixel can be enhanced.

Figure 15:
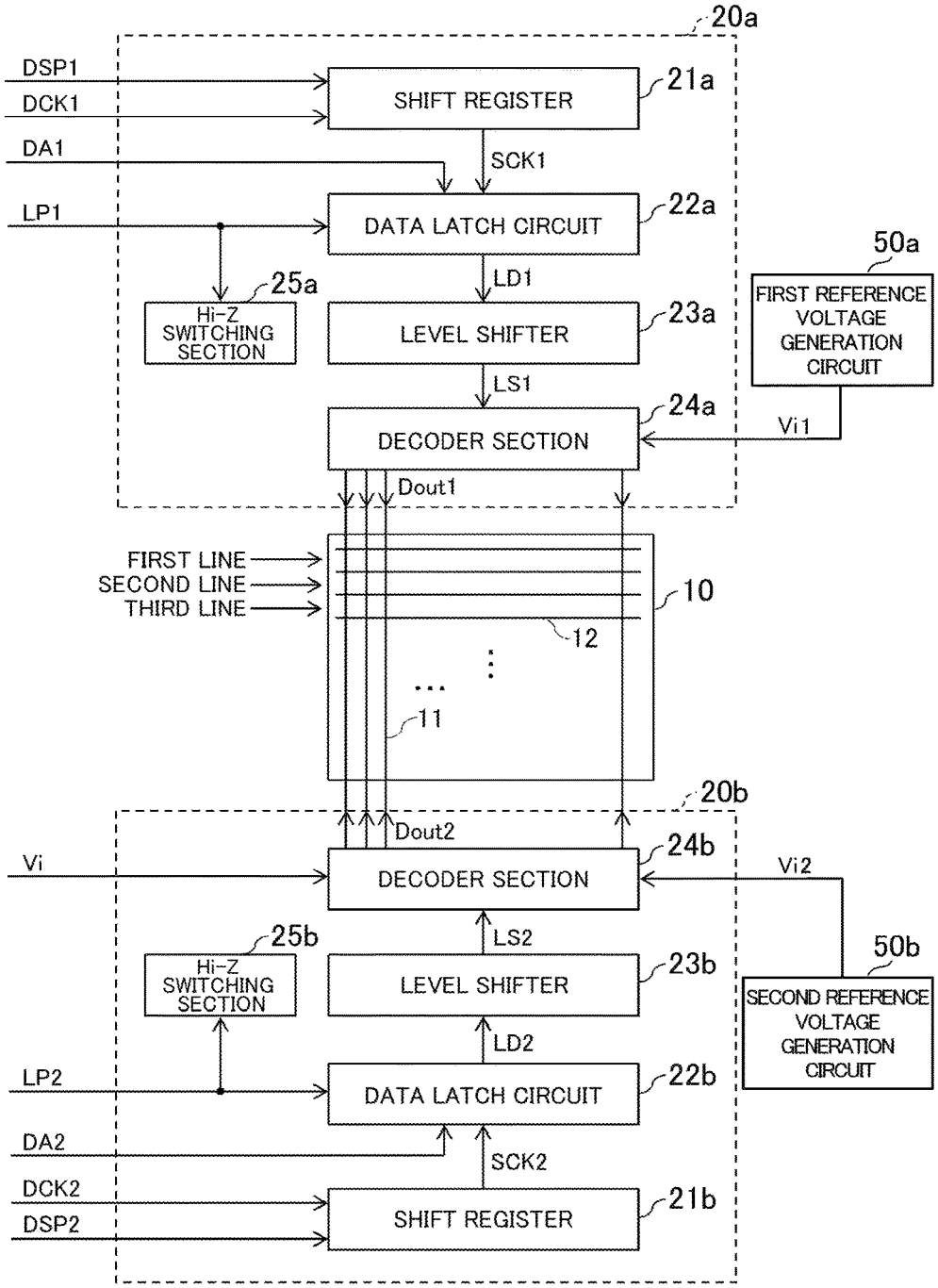
FIG. 15 is a block diagram illustrating another configuration of the liquid crystal display device illustrated in FIG. 6.
Figure 16:
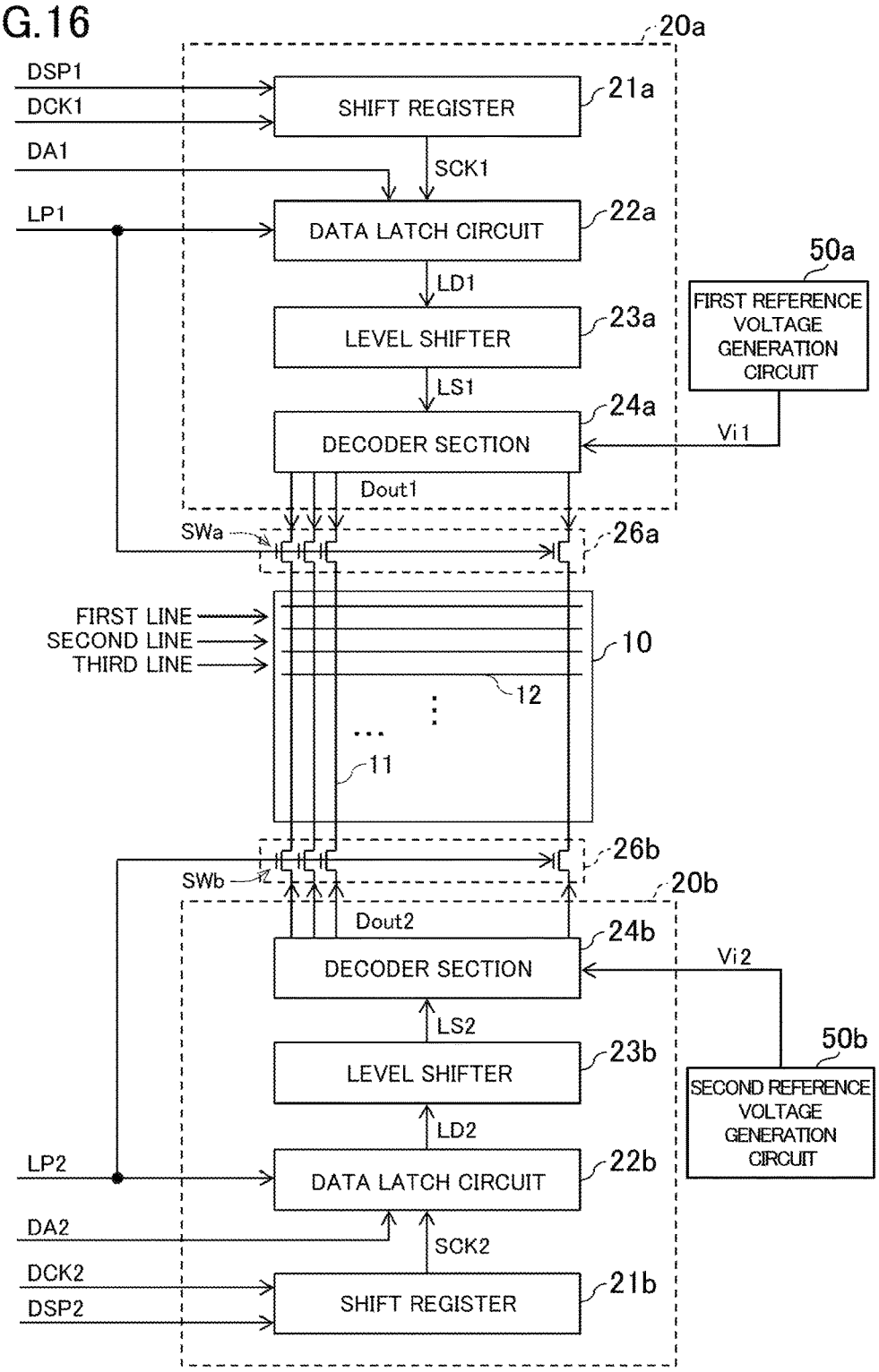
FIG. 16 is a block diagram illustrating another configuration of the liquid crystal display device illustrated in FIG. 9.

In this case, the first data line driver circuit 20*a* and the second data line driver circuit 20*b* are each configured more specifically so as to select and output a desired display grayscale voltage to the data line 11 based on the control signals and the display data input from the display control circuit 40 and the reference voltage Vi input from a reference voltage generation circuit. The number of the reference voltage generation circuits to be provided in the liquid crystal display device 100 may be one or two. For example, as illustrated in each of FIGS. 15 and 16, a first reference voltage generation circuit 50*a* may generate a first reference voltage Vi1, and output the first reference voltage Vi1 to the first data line driver circuit 20*a*, and a second reference voltage generation circuit 50*b* may generate a second reference voltage Vi2, and output the second reference voltage Vi2 to the second data line driver circuit 20*b*. In this case, the first reference voltage Vi1 and the second reference voltage Vi2 may be set to different voltages to each other. In this manner, the grayscale voltage of the display data can be corrected.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A liquid crystal display device, comprising:

a display panel comprising a plurality of gate lines extending in a row direction and a plurality of data lines extending in a column direction;

a first data line driver circuit electrically connected to one end of each of the plurality of data lines;

a second data line driver circuit electrically connected to another end of the each of the plurality of data lines; and a display control circuit for inputting input display data from an outside, wherein, in a first half of one horizontal scanning period, the first data line driver circuit outputs a corrected grayscale voltage obtained by correcting an input grayscale voltage corresponding to the input display data to the plurality of data lines, and the second data line driver circuit is electrically disconnected from the plurality of data lines, and wherein, in a second half of one horizontal scanning period, the second data line driver circuit outputs an input grayscale voltage corresponding to the input display data to the plurality of data lines, and the first data line driver circuit is electrically disconnected from the plurality of data lines, wherein the first data line driver circuit is switched for one time every horizontal scanning period from an electrical connection to the plurality of data lines to electrical disconnection from the plurality of data lines;

wherein the second data line driver circuit is switched for one time every horizontal scanning period from an electrical disconnection to the plurality of data lines to electrical connection from the plurality of data lines.

2. The liquid crystal display device according to claim 1, wherein the display control circuit corrects an input grayscale corresponding to the input display data to one of a grayscale higher than a target grayscale and a grayscale lower than the target grayscale.

3. The liquid crystal display device according to claim 1, wherein the display control circuit generates, based on a horizontal synchronization signal input from the outside, a first data latch signal to be output to the first data line driver circuit and a second data latch signal to be output to the second data line driver circuit, and wherein the first data latch signal and the second data latch signal are shifted from each other by a half period of one horizontal scanning period.

4. The liquid crystal display device according to claim 3, wherein the first data line driver circuit comprises a first switching section for switching the first data line driver circuit itself to a high impedance state, and the second data line driver circuit comprises a second switching section for switching the second data line driver circuit itself to a high impedance state, wherein the first switching section sets the first data line driver circuit to the high impedance state in a period during which the first data latch signal is at High level, and wherein the second switching section sets the second data line driver circuit to the high impedance state in a period during which the second data latch signal is at High level.

5. The liquid crystal display device according to claim 3, further comprising:

a first switch section connected between the first data line driver circuit and the one end of the each of the plurality of data lines; and a second switch section connected between the second data line driver circuit and the another end of the each of the plurality of data lines, wherein the first switch section is switched on and off based on the first data latch signal, and wherein the second switch section is switched on and off based on the second data latch signal.

6. The liquid crystal display device according to claim 5, wherein, when the first data latch signal is at Low level, the first switch section becomes an ON state, and the first data line driver circuit is electrically connected to the one end of the each of the plurality of data lines, wherein, when the first data latch signal is at High level, the first switch section becomes an OFF state, and the first data line driver circuit is electrically disconnected from the one end of the each of the plurality of data lines, wherein, when the second data latch signal is at Low level, the second switch section becomes an ON state, and the second data line driver circuit is electrically connected to the another end of the each of the plurality of data lines, and wherein, when the second data latch signal is at High level, the second switch section becomes an OFF state, and the second data line driver circuit is electrically disconnected from the another end of the each of the plurality of data lines.

7. The liquid crystal display device according to claim 1, further comprising:

a first switch section connected between the first data line driver circuit and the one end of the each of the plurality of data lines; and a second switch section connected between the second data line driver circuit and the another end of the each of the plurality of data lines, wherein the first switch section is switched on and off based on a first switching signal output from the display control circuit, and wherein the second switch section is switched on and off based on a second switching signal output from the display control circuit.

8. The liquid crystal display device according to claim 1, wherein the first data line driver circuit is arranged in a vicinity of a lower side of the display panel, and the second data line driver circuit is arranged in a vicinity of an upper side of the display panel.

9. The liquid crystal display device according to claim 1, further comprising:

a first reference voltage generation circuit that generates a first reference voltage, and outputs the first reference voltage to the first data line driver circuit; and a second reference voltage generation circuit that generates a second reference voltage, and outputs the second reference voltage to the second data line driver circuit, wherein the first reference voltage and the second reference voltage are set to different voltages to each other.

10. The liquid crystal display device according to the claim 1, wherein the corrected grayscale voltage output from the first data line driver circuit in the first half of one horizontal scanning period is different from the input grayscale voltage output from the second data line driver circuit in the second half of one horizontal scanning period.

11. A liquid crystal display device, comprising:

a display panel comprising a plurality of gate lines extending in a row direction and a plurality of data lines extending in a column direction;

a first data line driver circuit electrically connected to one end of each of the plurality of data lines;

a second data line driver circuit electrically connected to another end of the each of the plurality of data lines; and a display control circuit for inputting input display data from an outside, wherein a display region of the display panel is divided into an upper-half first region and a lower-half second region, wherein the first data line driver circuit is arranged in a vicinity of an upper side of the display panel, and the second data line driver circuit is arranged in a vicinity of a lower side of the display panel, wherein, in the upper-half first region, in a first half of one horizontal scanning period, the first data line driver circuit outputs a corrected grayscale voltage obtained by correcting an input grayscale voltage corresponding to the input display data to the plurality of data lines, and the second data line driver circuit is electrically disconnected from the plurality of data lines, and, in a second half of one horizontal scanning period, the second data line driver circuit outputs an input grayscale voltage corresponding to the input display data to the plurality of data lines, and the first data line driver circuit is electrically disconnected from the plurality of data lines, and wherein, in the lower-half second region, in the first half of one horizontal scanning period, the second data line driver circuit outputs a corrected grayscale voltage obtained by correcting the input grayscale voltage corresponding to the input display data to the plurality of data lines, and the first data line driver circuit is electrically disconnected from the plurality of data lines, and, in the second half of one horizontal scanning period, the first data line driver circuit outputs the input grayscale voltage corresponding to the input display data to the plurality of data lines, and the second data line driver circuit is electrically disconnected from the plurality of data lines, wherein the first data line driver circuit is switched for one time every horizontal scanning period from an electrical connection with the plurality of data lines to electrical disconnection from the plurality of data lines in the upper-half first region, and wherein the first data line driver circuit is switched for one time every horizontal scanning from an electrical disconnection from the plurality of data lines to an electrical connection with the plurality of data lines period in the lower-half first region.

12. The liquid crystal display device according to the claim 11, wherein in the upper-half first region, the corrected grayscale voltage output from the first data line driver circuit in the first half of one horizontal scanning period is different from the input grayscale voltage output from the second data line driver circuit in the second half of one horizontal scanning period.

* * * * *